US006360386B1

(12) United States Patent
Chuang

(10) Patent No.: US 6,360,386 B1
(45) Date of Patent: Mar. 26, 2002

(54) SICKBED

(76) Inventor: Paul Chuang, No. 16, Pin-An Cheng Hou Bei Shiang, Tainan (TW)

( * ) Notice: Subject to any disclaimer, the term of this patent is extended or adjusted under 35 U.S.C. 154(b) by 0 days.

(21) Appl. No.: 09/586,260

(22) Filed: May 31, 2000

(51) Int. Cl.[7] ..... A61G 7/008
(52) U.S. Cl. ..... 5/618; 5/607; 5/612; 5/613
(58) Field of Search ..... 5/610, 612, 613, 5/617, 618, 933, 607, 608, 609

(56) References Cited

U.S. PATENT DOCUMENTS 2,445,158 A * 7/1948 Sparhawk ..... 5/933
3,300,793 A * 1/1967 Thompson ..... 5/608
5,125,122 A * 6/1992 Chen ..... 5/618
5,640,729 A * 6/1997 Marino ..... 5/607

* cited by examiner

*Primary Examiner*—Lynne H. Browne
*Assistant Examiner*—Fredrick Conley
(74) *Attorney, Agent, or Firm*—Pro-Techtor International Services

(57) ABSTRACT

A sickbed, comprising: a base frame; a main bed frame, having several tilting sections that are movable for having the patient sit up; a movable bed frame for lifting the body of the patient above the main bed frame, so as to relieve pressure from the main bed frame and to prevent bedsore; a left turning bed frame and a right turning bed frame for turning the body of the patient; a first link rod group, driving the tilting sections; a second link rod group, driving the movable bed frame; a power device, having a driving shaft, driving intermittent independent movements of the first and second link rod groups; a turning system driving the left and right turning bed frames; and a shaking device, generating an oscillatory movement of the left and right turning bed frames for massaging the patient.

10 Claims, 10 Drawing Sheets

SICKBED

BACKGROUND OF THE INVENTION

1. Field of the Invention

The present invention relates to a sickbed, particularly to a sickbed for persons requiring long-term care.

2. Description of Related Art

Persons affected by bone fractures, spine injuries, concussions of the brain or persons in a vegetative state are unable to move and therefore have to stay in bed for extended periods. This easily leads to bedsore. Once sores or ulcers have occurred, not only the sick are suffering, but also nursing people have to carry a large burden.

Since people who are unable to move have to stay in bed most of the time, the design of beds is of great importance for patients and nursing people. Regular beds are not suitable for patients who are unable to move because of increased risk of bedsore and resulting higher nursing efforts.

Bedsore mainly develops because of pressure on the skin of the patient, poor blood circulation and insufficient ventilation, leading to damp heat and finally to ulcers. To prevent this, a nurse has to massage the skin of the patient from time to time to stimulate blood circulation. While for most patients a nurse is available, the rate of patients affected by sores or ulcers is still relatively high.

Feeding the patient with food or medicine, washing them or changing clothes requires to raise or to turn the body. For this purpose, beds driven electrically or by oil pressure have been developed, saving the nurse the effort to raise the upper body or to turn the body around manually. However, a sickbed has to perform several movements, which conventionally need several driving systems, making the sickbed expensive beyond the reach of a household of low income. Conventional sickbeds therefore do not solve the problem of sores and ulcers for simple hospitals and households of low income and cannot relieve patients bound to bed from suffering, nor facilitate nursing efforts.

SUMMARY OF THE INVENTION

The main object of the present invention is to provide a sickbed with improved ventilation, preventing pressure on the skin of the patient, such that bedsore or ulcers will not develop.

Another object of the present invention is to provide a sickbed, which helps to raise or turn the body of the patient to facilitate nursing efforts.

A further object of the present invention is to provide a sickbed with a simple structure and low cost.

The present invention can be more fully understood by reference to the following description and accompanying drawings.

DETAILED DESCRIPTION OF THE PREFERRED EMBODIMENTS

Figure 1:
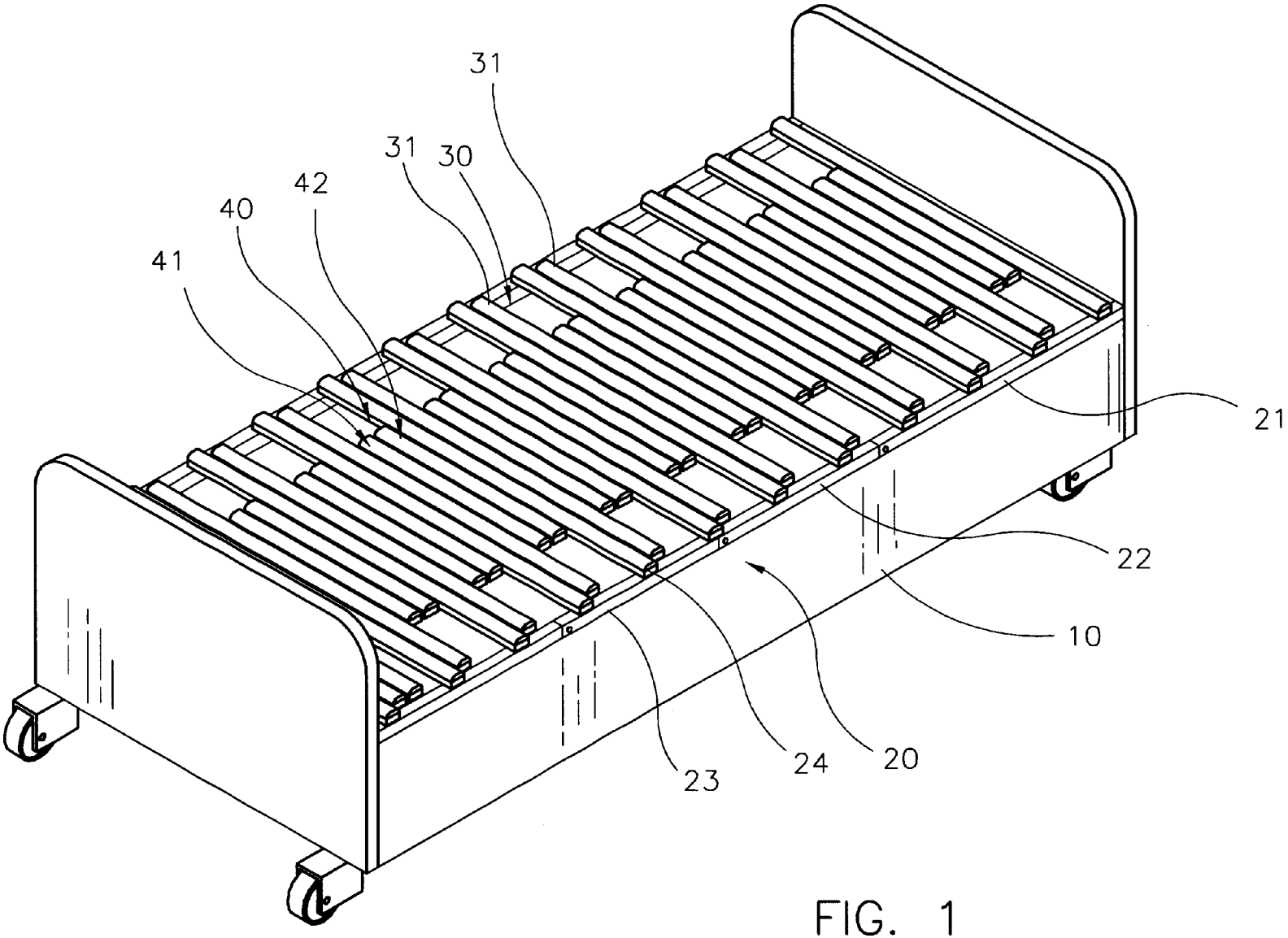
FIG. 1 is a perspective view of the sickbed of the present invention.
Figure 2:
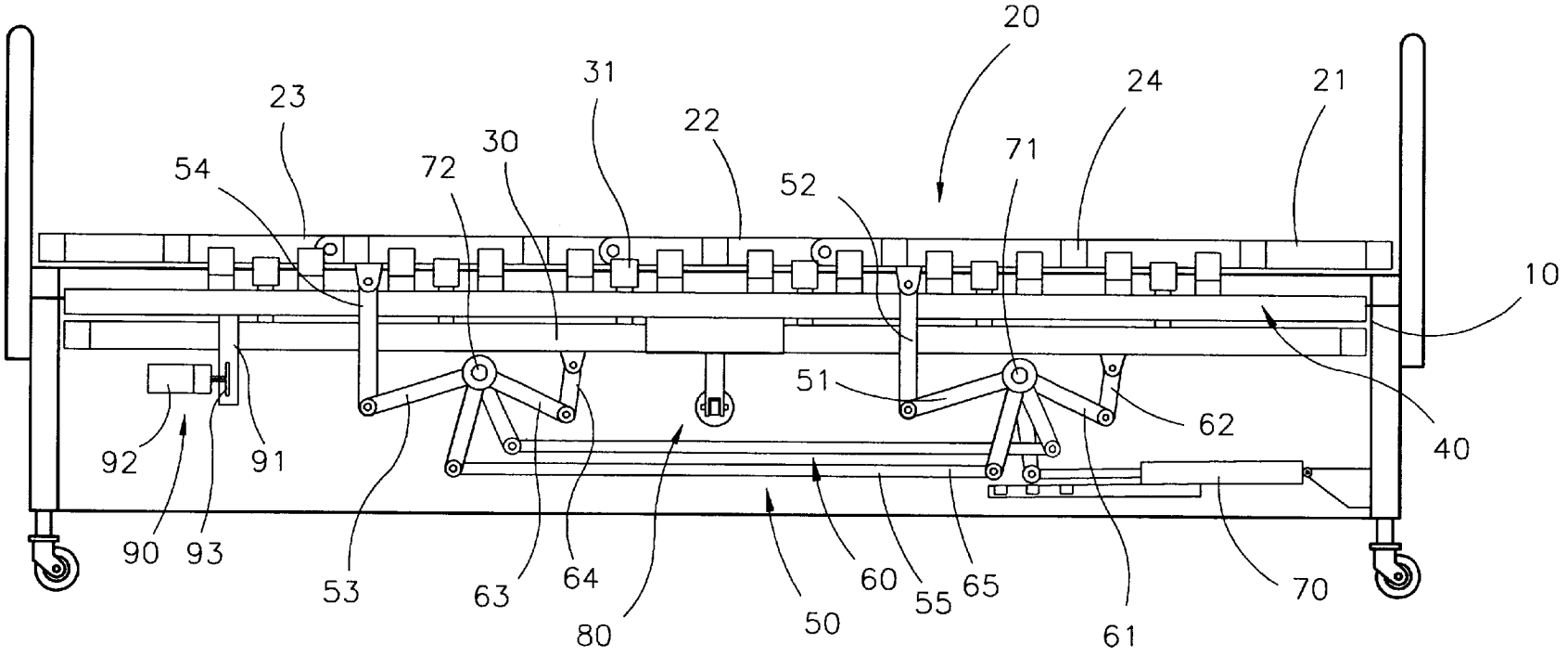
FIG. 2 is a side view of the sickbed of the present invention.

As shown in FIGS. 1 and 2, the sickbed of the present invention in a first embodiment mainly comprises: a base frame 10 with a front end and a rear end, defining a longitudinal direction; a main bed frame 20, horizontally mounted on the base frame 10, supporting a lying patient and allowing to lift the upper body and the lower parts of the patient; a movable bed frame 30, movable up and down to change pressure points between the bed and the skin of the patient; a turning bed frame 40 for turning the patient; a first link rod group 50, mounted below the main bed frame 20, driving the main bed frame 20; a second link rod group 60, mounted below the main bed frame 20, driving the movable bed frame 30; a power device 70, driving the first and second link rod groups 50, 60; a turning system 80, driving the turning bed frame 40; and a shaking device 90, shaking the turning bed frame 40 to massage the body of the patient and to stimulate blood circulation.

The sickbed of the present invention uses the main bed frame 20 to have the patient sit up and the turning frame 40 to turn the patient right or left. Thus the efforts of a nurse to feed, wash and dress the patient are greatly facilitated.

Figure 4:
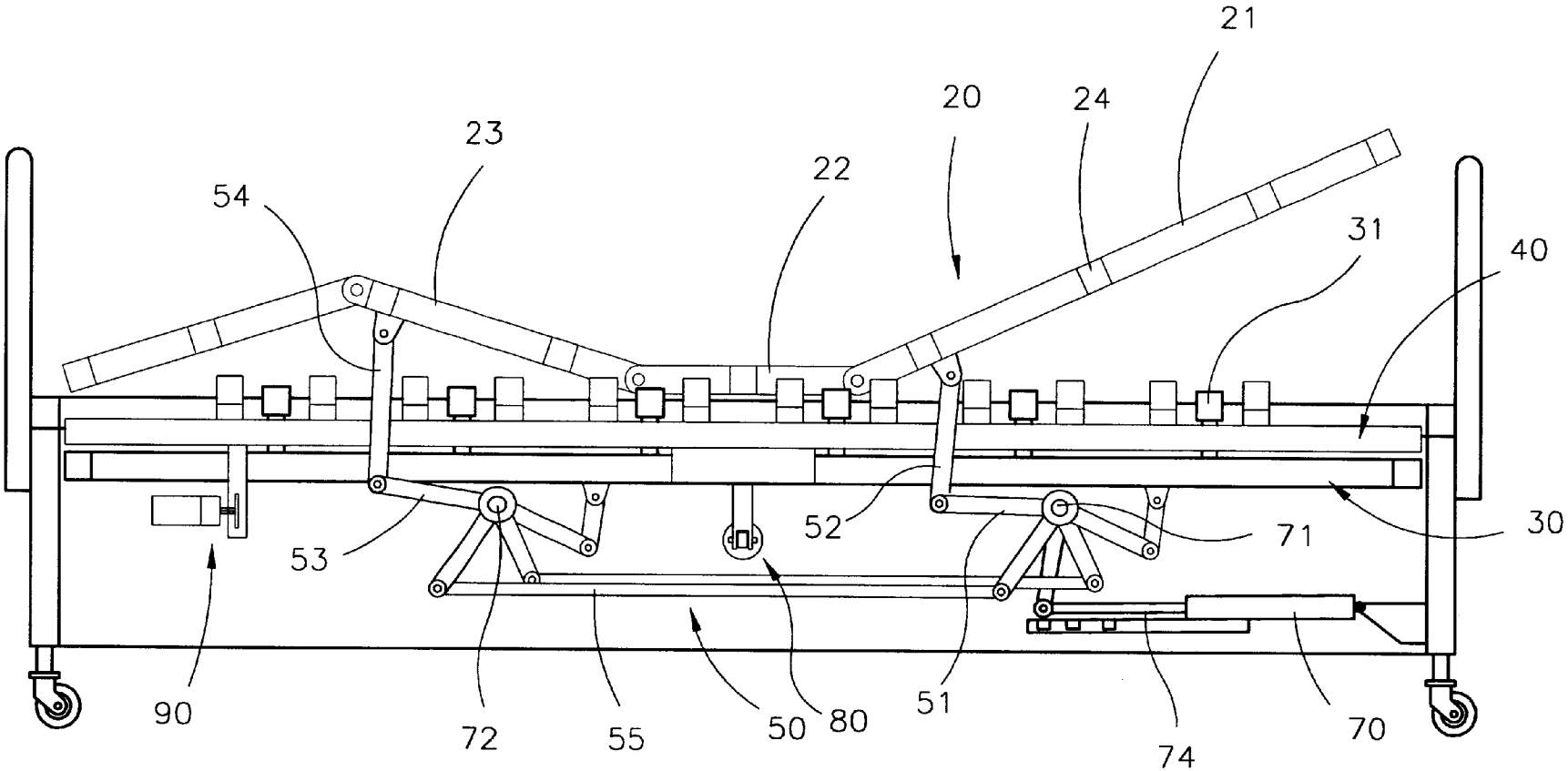
FIG. 4 is a schematic illustration of the sickbed of the present invention in the elevated position.

Referring to FIGS. 2 and 4, the main bed frame 20 is a flexible frame body, having a front tilting section 21, on which the upper body of the patient rests, a fixed middle section 22, and a rear tilting section 23. The front and rear movable tilting sections 22, 23 are connected with the first link rod group 50 and thereby driven to rise from a flat position to an elevated position. In the elevated position, the upper body of the patient is raised and the knees of the patient are bent.

As shown in FIG. 4, the first link rod group 50 comprises: a front toggle link 51, mounted on a primary driving shaft 71 and revolving around the primary driving shaft 71, driven by a rotational movement thereof; a link rod 52, connecting the front toggle link 51 with the front movable section 21; a rear toggle link 52, mounted on a secondary driving shaft 72 and driven by a rotational movement thereof; a link rod 54, connecting the rear toggle link 52 with the rear movable section 23; and a transmission rod 55, connecting the front and rear toggle links 51, 53, such that the rear toggle link 53 is driven by the front toggle link 51.

Figure 3:
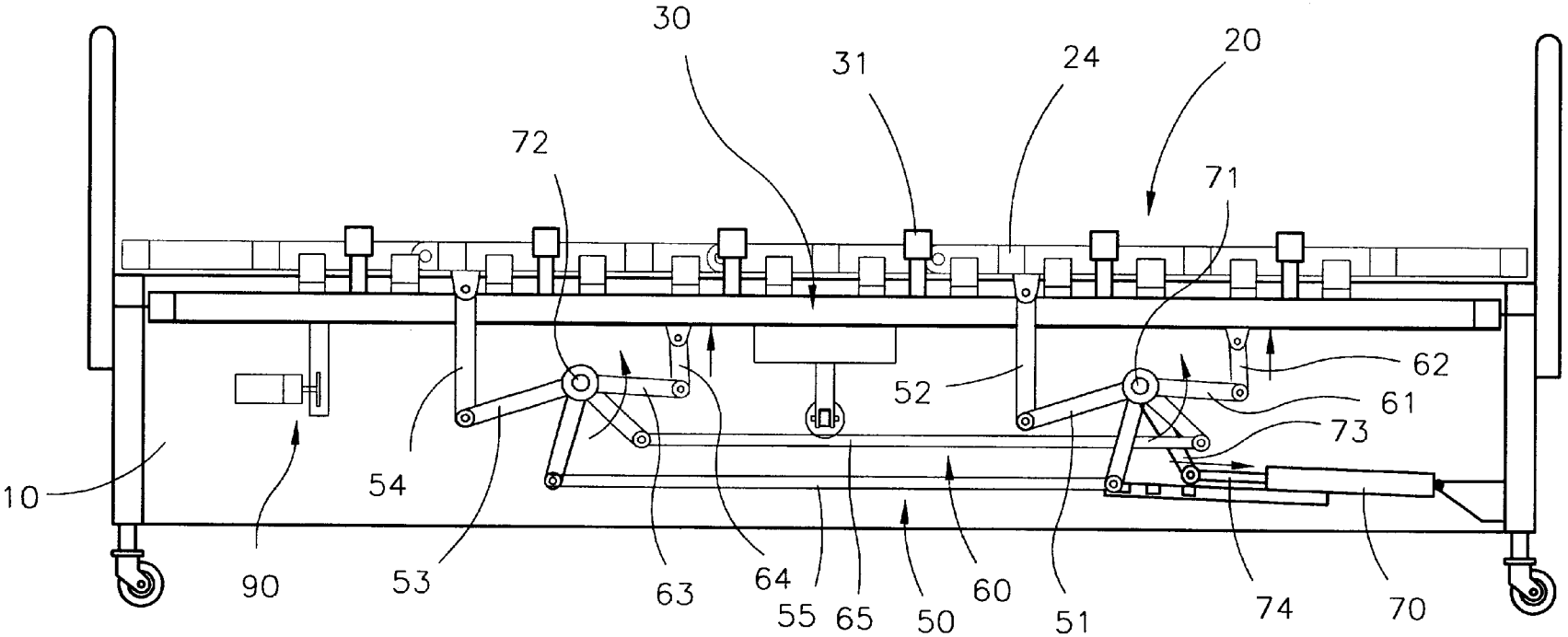
FIG. 3 is a schematic illustration of the sickbed of the present invention in the flat position.

As shown in FIGS. 2 and 3, the main bed frame 20 has a rectangular outer frame and a plurality of transverse support planks 24, supporting the patient. The movable bed frame 30 is mounted below the main bed frame 20 and movable between an upper position and a lower position. A plurality of contact planks 31 are mounted on the movable bed frame 30 in positions between the support planks 24. With the movable bed frame 30 in the upper position, the contact planks 31 stand out above the support planks 24.

For using the sickbed of the present invention, soft padding is laid on the main bed frame 20 to provide for a comfortable support. As long as the movable bed frame 30 has not moved from the lower position, the weight of the patient rests solely on the support planks 24. When the movable bed frame 30 moves upward to stand out above the main bed frame 20, pressure on the patient's skin shifts from the locations of the support planks 24 to the locations of the contact planks 31. Thus by moving the movable bed frame 30 between the upper and lower positions, pressure points on the skin of the patient are changed. By preventing pressure to act on certain spots of the patient's skin for an extended period, insufficient blood circulation and bedsore will not result.

Referring to FIG. 3, the second link rod group 60 drives the upward and downward movement of the moving bed frame 30. The second link rod group 60 comprises: a front toggle link 61 and a rear toggle link 63, respectively driven by the primary and secondary driving shafts 71, 72; a link rod 62, connecting the front toggle link 61 with the movable bed frame 30; and a link rod 64, connecting the rear toggle link 63 with the movable bed frame 30. When the front and rear toggle links 61, 63 revolve upward, the movable bed frame 30 is taken upward by transmission of the link rods 62, 64. The front toggle link 61 is driven by the primary driving shaft 71, and the rear toggle link 63 is connected to the front toggle link 61 by a transmission rod 65, moving simultaneously with the front toggle link 61.

Figure 5:
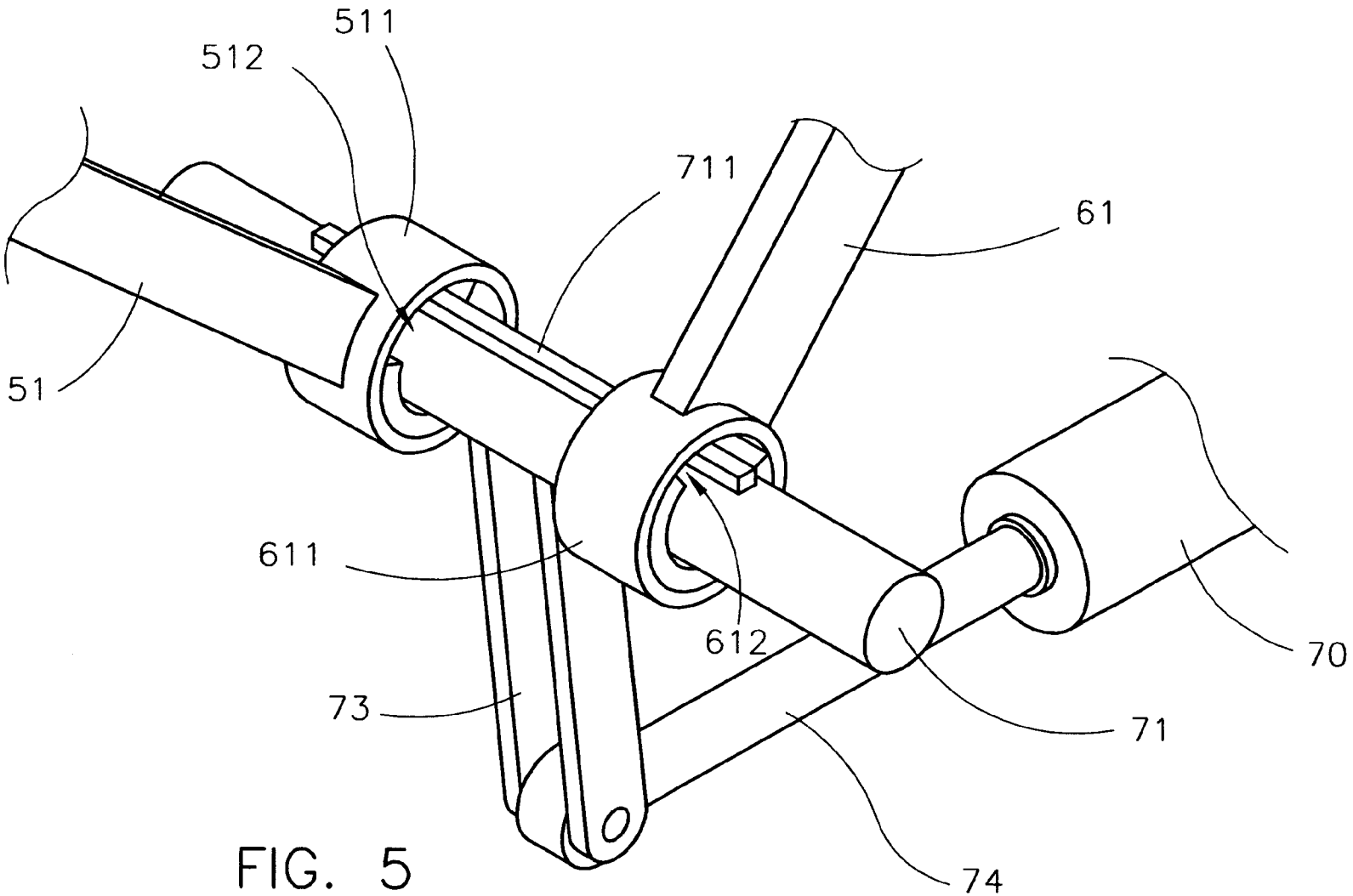
FIG. 5 is an enlarged perspective view of the driving device of the present invention.

One of the main characteristics of the sickbed of the present invention is the common power device 70 for the first and second link rod groups 50, 60, allowing for a simplified structure and reduced cost of the sickbed. As shown in FIG. 5, the toggle links 51, 61 of the first and second link rod groups 50, 60 share the primary driving shaft 71. A connecting rod 73 is welded to the primary driving shaft 71, having a free end that is driven by the power device 70. The power device 70 is an oil pressure cylinder, a linear motor or another driving device. A pushing rod 74 extends from the power device 70, having a free and that is connected to the connecting rod 73. When the power device 70 pushes out or pulls in the pushing rod 74, the primary driving shaft 71 is turned via the connecting rod 73, and the front toggle links 51, 61 move, such that the main bed frame 20 and the movable bed frame 30 shift positions.

To have the main bed frame 20 and the movable bed frame 30 move independently, letting the main bed frame 20 move while the movable bed frame 30 rests and vice versa, the first link rod group 50 has to be able to move while the second link rod group 60 rests and vice versa. For this purpose, the primary driving shaft 71 drives the first and second link rod groups 50, 60 intermittently. In a first angular position, the rotational movement of the primary driving shaft 71 takes along the front toggle link 51 of the first link rod group 50 while leaving the front toggle link 61 of the second link rod group 60 at rest. On the other hand, in a second angular position, the rotational movement of the primary driving shaft 71 takes along the front toggle link 61 of the second link rod group 60 while leaving the front toggle link 51 of the first link rod group 50 at rest. Thus a single power device 70 is able to drive the first and second link rod groups 50, 60 independently.

Referring to FIG. 5, intermittent driving of the first link rod group 50 by the primary driving shaft 71 is done by an intermittent catch ring 511. In the same way, intermittent driving of the second link rod group 60 by the primary driving shaft 71 is done by an intermittent catch ring 611. The intermittent catch rings 511, 611 respectively have recessions 512, 612 of certain angular widths on inner sides thereof, and the primary driving shaft has a longitudinal ridge 711. The ridge 711 passes through the recessions 512, 612 either freely or in contact with the intermittent catch ring 511 or 611 at contact areas. When the primary driving shaft 71 rotates, the ridge 711 moves freely along the recessions 512, 612 until reaching a contact area, and then starts to take along the intermittent catch ring 511 or 611, causing the toggle link 51 or the toggle link 61 to revolve.

The recessions 512, 612 have different angular ranges on the primary driving shaft 71. When the primary driving shaft 71 rotates towards the front end of the base frame 20, the ridge 711 presses against a contact area on the recession 512 and causes the toggle link 51 of the first link rod group 50 to revolve upward. At the same time, the ridge 711 moves freely along the recession 612, leaving the toggle link 61 of the second link rod group 60 at rest. Conversely, when the primary driving shaft 71 rotates towards the rear end of the base frame 20, the ridge 711 presses against a contact area on the recession 612 and causes the toggle link 61 of the second link rod group 60 to revolve upward. At the same time, the ridge 711 moves freely along the recession 512, leaving the toggle link 51 of the first link rod group 50 at rest.

Figure 6:
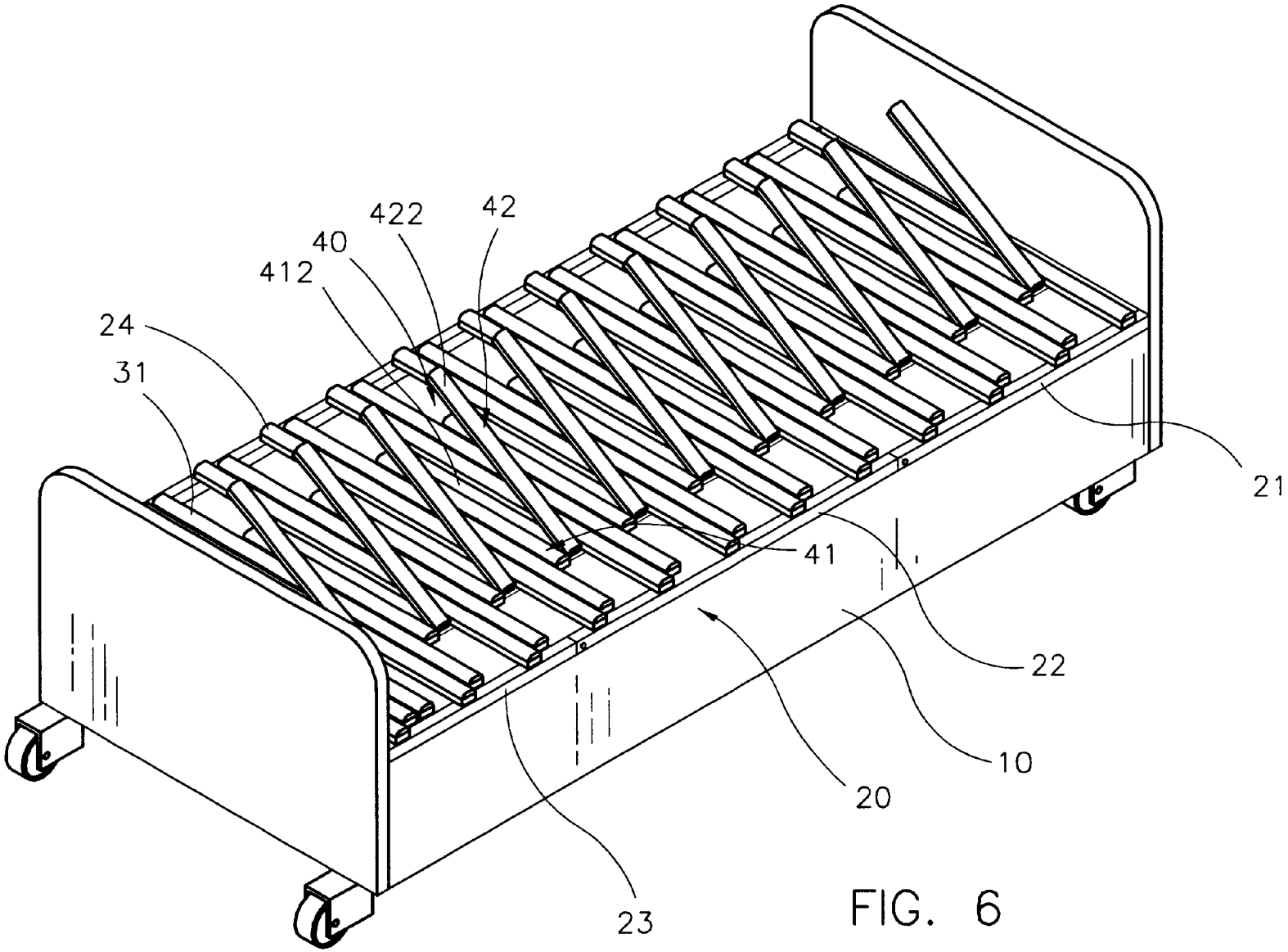
FIG. 6 is a perspective view of the sickbed of the present invention with the turning system elevated on one side.
Figure 7:
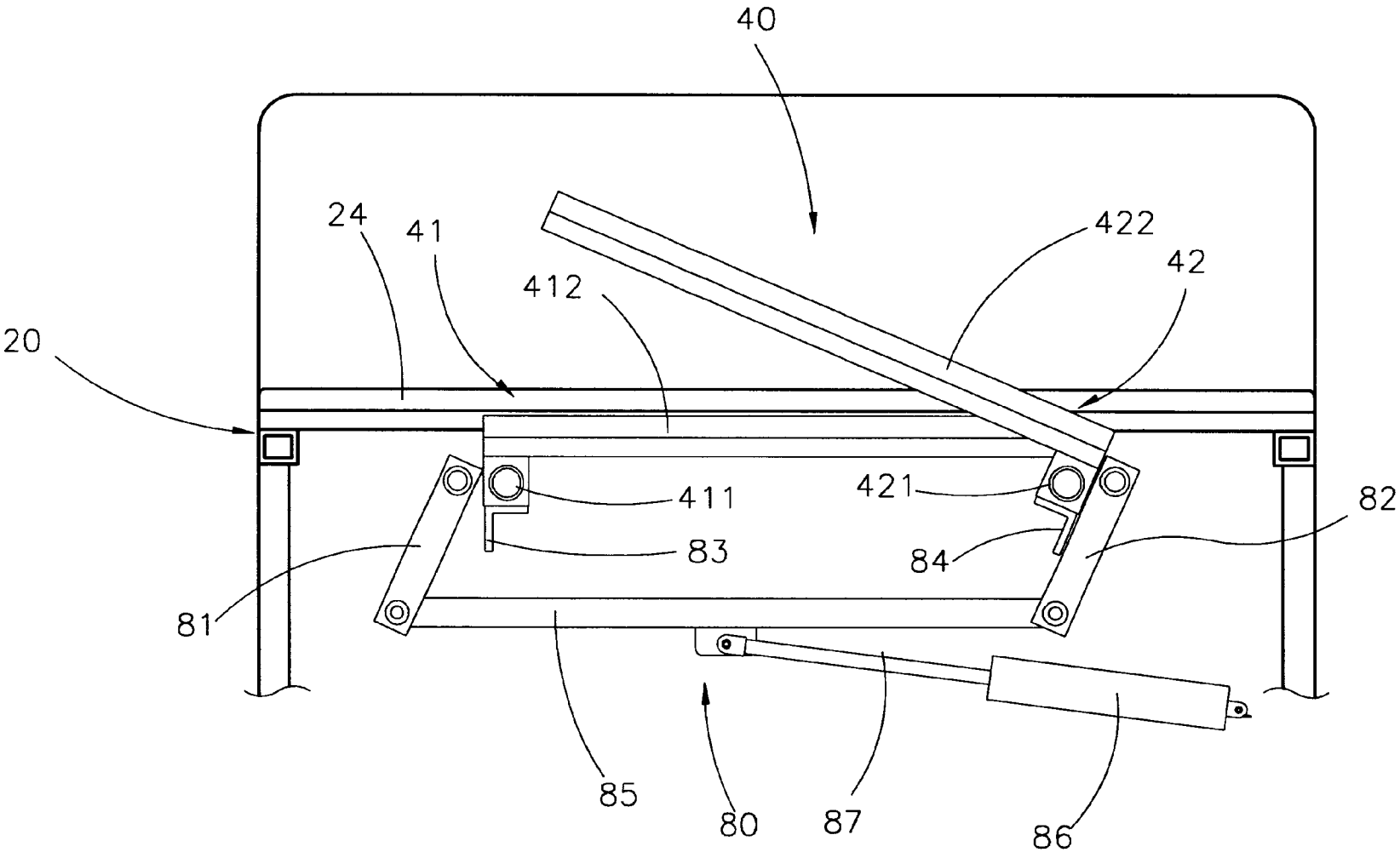
FIG. 7 is a front view of the turning system of the present invention.

Referring now to FIGS. 6 and 7, the turning bed frame 40 comprises a left side frame 41 and a right side frame 42. The left and right side frames 41, 42 have turning shafts 411, 421, each with a periphery, and a plurality of turning planks 412, 422, which are respectively attached to the turning shafts 411, 421. The turning planks 412, 422 are located in gaps left by the support planks 24 and the contact planks 31. Rotational movements of the turning shafts 411, 421 are driven by the turning system 80, resulting in the turning planks 412, 422 to be elevated, such that the body of the patient will be turned.

A conventional electric sickbed with turning frames needs two power devices for driving the turning frames. For the sickbed of the present invention, however, a single power device is sufficient to drive the left and right side frames 41, 42. As shown in FIG. 7, the turning system 80 comprises: two link rods 81, 82 with upper ends hingedly mounted close to the peripheries of the turning shafts 411, 421, respectively, and lower ends; two push plates 83, 84, respectively fastened to the turning shafts 411,421 and extending downward therefrom; a connecting rod 85, connecting the lower free ends of the link rods 81, 82; a power device 86, which is an oil-pressure cylinder or an electric motor; and a pushing rod 87, pushed back and forth by the power device 86 and having a free end that is connected to the connecting rod. The two push plates 83, 84 are each shaped like the letter L and have outer sides next to the link rods 81, 82. When the link rod 81 moves inward, the push plates 83 is pressed on, and the turning shaft 411 rotates, lifting the plurality of turning planks 412. In the same way, when the link rod 82 moves inward, the push plates 84 is pressed on, and the turning shaft 421 rotates, lifting the plurality of turning planks 422.

Figure 8:
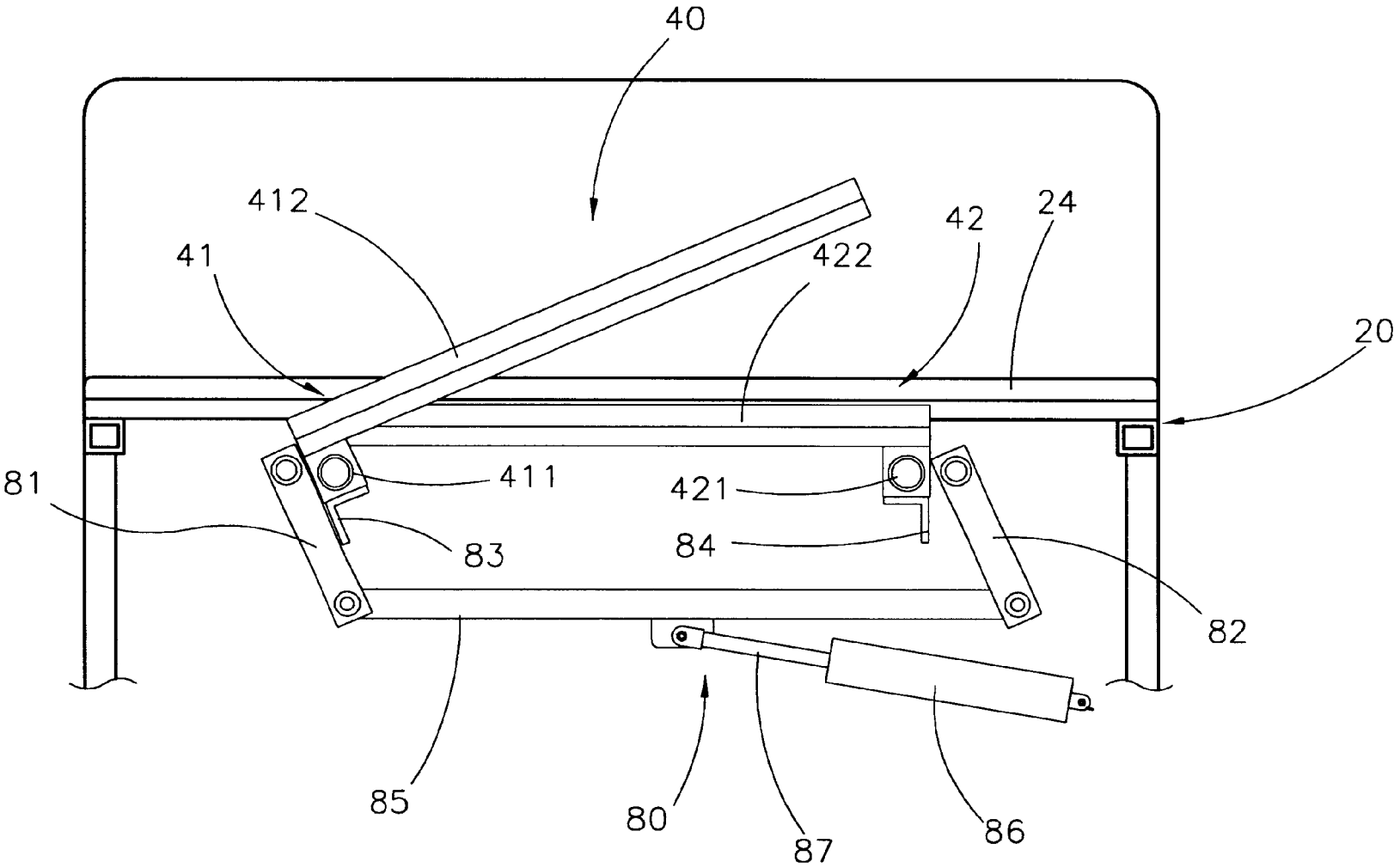
FIG. 8 is a schematic illustration of the movement of the turning system of the present invention.

Since the link rods 81, 82 are not fastened to the push plates 83, 84, each of the push plates 83, 84 will only move when pushed inward. Any of the link rods 81, 82 when moving outward will not exert a force on the push plates 83, 84. Therefore, as shown in FIG. 7, when the pushing rod 87 is pushed out, the connecting rod 85 shifts to the left, taking along the two link rods 81, 82, the push plate 84 is pushed against, and the right side frame 42 is elevated, with the push plate 83 experiencing no force and the left side frame 41 staying at rest. Conversely, as shown in FIG. 8, when the pushing rod 87 is pulled in, the connecting rod 85 shifts to the right, taking along the two link rods 81, 82, the push plate 83 is pushed against, and the left side frame 41 is elevated, with the push plate 84 experiencing no force and the right side frame 42 staying at rest.

The turning system 80 of the present invention is able to lift one of the left and right side frames 41, 42, turning the body of the patient to the right or the left, assisting efforts of a nurse.

Figure 9:
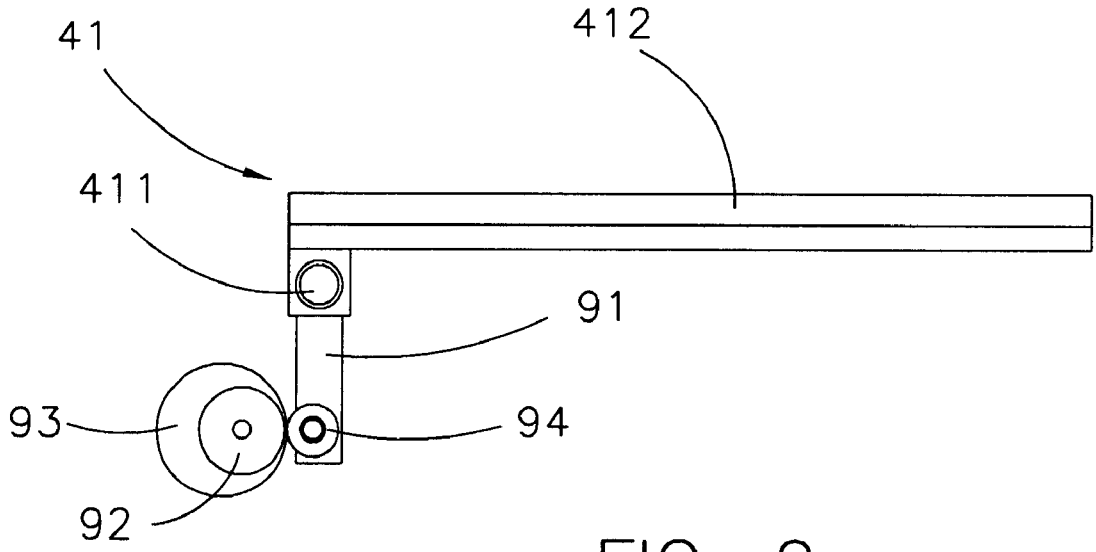
FIG. 9 is a front view of the shaking device of the present invention.
Figure 10:
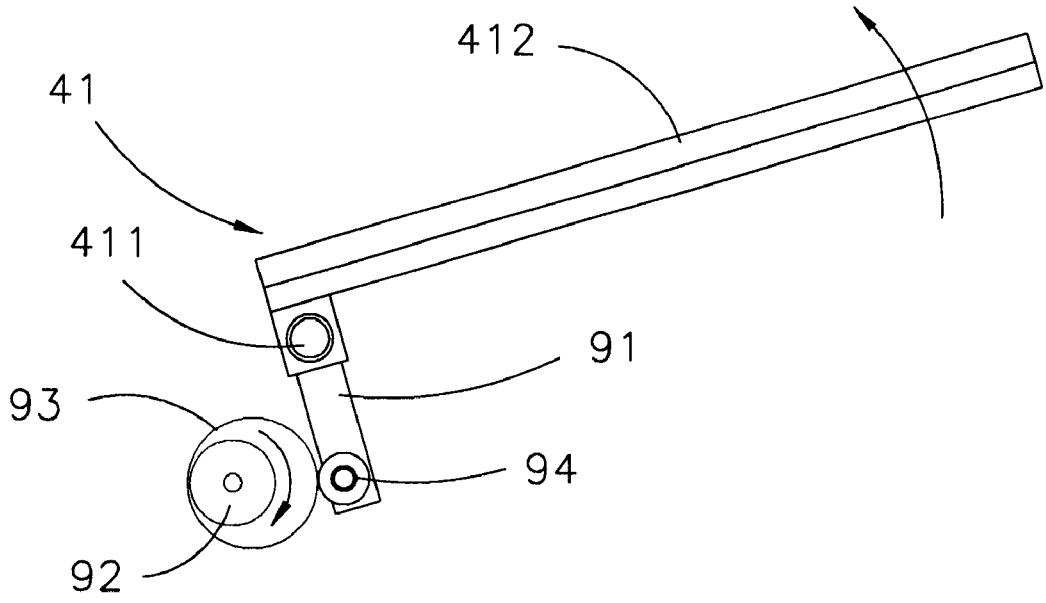
FIG. 10 is a schematic illustration of the movement of the shaking device of the present invention.

The shaking device 90 generates a small and fast oscillatory movement of the left side frame 41 or the right side frame 42, massaging the body of the patient, furthering blood circulation and preventing muscle atrophy. As shown in FIG. 9, the shaking device 90 comprises: a shaking rod 91; extending downward from the turning shaft 411, 421, having a free end; a motor 92; a camshaft 93, driven by the motor and located close to the free end of the shaking rod 91; and a roll 194, mounted on the free end of the shaking rod 91 and rotating, as driven by the camshaft 93. As shown in FIG. 10, rotating the camshaft 93 causes the shaking rod 91 to move back and forth, such that the left or right side frame 41, 42 performs a shaking movement, massaging the patient.

The power device 70, the turning system 80 and the shaking device 90 are controlled by a control circuit (not shown in the FIGS.) or manually for lifting, turning or massaging the patient. A control circuit preferably has a predetermined program for time-dependent movements of the main bed frame 20, the movable bed frame 30 and the turning bed frame 40. Thus the patient is automatically turned and massaged, and pressure points on the patient's skin are automatically changed, such that bedsore and muscle atrophy will not develop.

Figure 11:
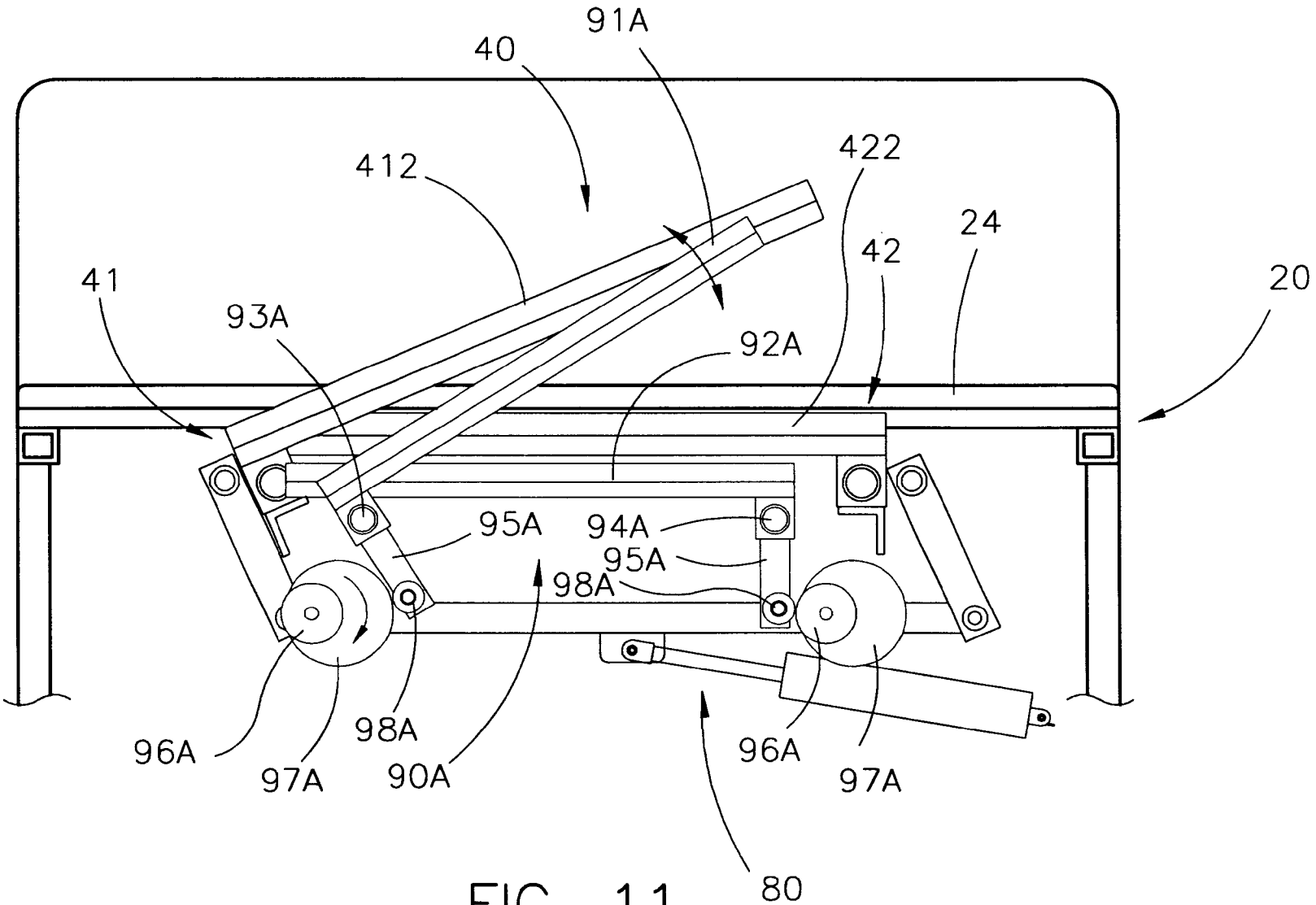
FIG. 11 is a front view of the shaking device of the present invention in the second embodiment.

Referring to FIG. 11, the present invention in a second embodiment has a shaking device 90A which is separate from the turning bed frame 40 and comprises: a plurality of left shaking planks 91A and a plurality of right shaking planks 92A, located in gaps left by the plurality of support planks 24, moving planks 31 and left and right turning planks 41, 42; a left shaft 93A and a right shaft 94A, to which the plurality of left and right planks 91A, 92A are attached, respectively, and which by turning elevate the plurality of left and right planks 91A, 92A; two shaking rods 95A, extending downward from the left and right shafts 93A, 94A and having free ends with rolls; two motors 96A; and two camshafts 97A, respectively driven by the two motors 96A. Rotating the camshafts 97A, causes the rolls 98A to rotate and drives oscillatory movements of the left and right shafts 93A, 94A.

The left and right shaking planks 91A, 92A move independent from the left and right support planks 41, 42, as shown in FIG. 11, and thus allow to massage the patient's body after turning.

While the invention has been described with reference to preferred embodiments thereof, it is to be understood that modifications or variations may be easily made without departing from the spirit of this invention which is defined by the appended claims.

What is claimed is:

1. A sickbed for a patient, comprising:

a base frame, with left and right sides, extended along a horizontal plane, with upward and downward directions perpendicular thereto;

a main bed frame, having several tilting sections that are movable for having said patient sit up;

a movable bed frame, movable upward and downward, having a plurality of contact planks for lifting the body of said patient above said main bed frame, so as to relieve pressure from said main bed frame and to prevent bedsore;

a left turning bed frame and a right turning bed frame for turning the body of said patient to said right and left sides;

a first link rod group, driving said several tilting sections;

a second link rod group, driving said movable bed frame;

a power device, having a driving shaft, driven by said power device in a turning movement and driving said first and second link rod groups via two intermittent transmitting elements, such that said first and second link rod groups move independently to have said patient sit up or to change pressure points on said patient;

a turning system, having two link rods, driving said left and right turning bed frames for turning said patient; and a shaking device, generating an oscillatory movement of said left and right turning bed frames for massaging said patient.

2. A sickbed according to claim 1, wherein said driving shaft has a ridge and said power device further comprises a first intermittent catch ring and a second intermittent catch ring, mounted on said driving shaft and respectively connecting said driving shaft with said first and second link rod groups, each of said first and second intermittent catch rings having an inner recession covering an angular range, with said ridge passing through said recession, such that during said turning movement of said driving shaft said ridge moves freely along said recession or, at end points of said angular range, takes along said intermittent catch ring.

3. A sickbed according to claim 1, wherein said turning bed frame comprises:

a left side frame;

a right side frame; and two turning shafts, independently driven by said turning system to tilt said left and right side frames, respectively, for turning said patient.

4. A sickbed according to claim 3, wherein said two link rods of said turning system are mounted close to said two turning shafts, respectively, and said turning system further comprises:

two push plates, attached to said two turning shafts, respectively, and causing said two turning shafts to turn when pushed on by said two link rods;

a connecting rod, connecting said two link rods and driving said two link rods, driven by a power device.

5. A sickbed according to claim 3, further comprising two shaking devices, generating small movements of said left and right turning bed frames for massaging said patient.

6. A sickbed according to claim 5, wherein each of said two shaking devices further comprises:

a shaking rod, attached to said turning shaft and extending downward therefrom;

a motor;

a camshaft, driven by said motor and contacting said shaking rod to generate an oscillating movement of said shaking rod.

7. A sickbed according to claim 6, wherein said shaking rod further comprises a roll, contacted by said camshaft.

8. A sickbed according to claim 1, further comprising a shaking device, said shaking device further comprising:

a shaft;

a plurality of shaking planks, parallel oriented, attached to said shaft and performing an oscillating movement, as driven by said shaft;

a driving device, driving said shaft to generate said oscillating movement of said shaking planks.

9. A sickbed according to claim 8, wherein said driving device further comprises a shaking rod, attached to said shaft and extending downward therefrom;

a motor;

a camshaft, driven by said motor and contacting said shaking rod to generate an oscillating movement of said shaking rod.

10. A sickbed according to claim 9, wherein said shaking rod further comprises a roll, contacted by said camshaft.

* * * * *